US006820823B2

(12) United States Patent
Parsons et al.

(10) Patent No.: US 6,820,823 B2
(45) Date of Patent: Nov. 23, 2004

(54) AEROSOL DISPENSING NOZZLE

(75) Inventors: William G. Parsons, Racine, WI (US); Steven B. Mineau, Waterford, WI (US); Gary A. Hurtienne, Racine, WI (US); Stanley J. Flashinski, Racine, WI (US); Juan Carlos Blanco, Buenos Aires (AR)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/374,236

(22) Filed: Feb. 25, 2003

(65) Prior Publication Data

US 2004/0195374 A1 Oct. 7, 2004

(51) Int. Cl.[7] ..... F34D 14/24
(52) U.S. Cl. ..... 239/337; 222/131; 222/168
(58) Field of Search ..... 239/251, 337; 222/131, 168, 402.14, 167, 402.1, 548; D9/447, 448

(56) References Cited

U.S. PATENT DOCUMENTS

| | | | | |
|---|---|---|---|---|
| 1,234,959 A | | 7/1917 | Symonds | |
| 2,536,160 A | | 1/1951 | Duggan | |
| 3,195,783 A | * | 7/1965 | Crowell | D9/448 |
| D209,546 S | * | 12/1967 | Wahlin et al. | D9/447 |
| 3,382,871 A | | 5/1968 | Parry | |
| 3,572,591 A | | 3/1971 | Brown | |
| 4,568,002 A | * | 2/1986 | Weinstein et al. | 222/131 |
| 4,690,312 A | * | 9/1987 | Crapser et al. | 222/402.17 |
| D305,872 S | * | 2/1990 | Garcia | D9/448 |
| 5,068,099 A | | 11/1991 | Sramek | |
| 5,301,879 A | | 4/1994 | Takeda et al. | |
| 5,350,116 A | | 9/1994 | Cater | |
| 5,673,857 A | | 10/1997 | Meroni et al. | |
| 5,735,465 A | * | 4/1998 | Laforcade | 239/337 |
| D407,975 S | * | 4/1999 | Lund et al. | D9/447 |
| D411,801 S | * | 7/1999 | Kinneir et al. | D9/498 |
| 6,006,957 A | | 12/1999 | Kunesh | |
| D435,792 S | * | 1/2001 | Peloquin | D9/448 |

OTHER PUBLICATIONS

Japan Actuators (Admitted prior art).
Argentina Actuators (Admitted prior art).

* cited by examiner

*Primary Examiner*—Michael Mar
*Assistant Examiner*—Thach H. Bui

(57) ABSTRACT

A nozzle insert, and/or an actuator nozzle structure, for use in dispensing a material to be dispensed from an aerosol can. The nozzle insert or actuator nozzle structure divide the spray of dispensed material into two independent, simultaneously emitted aerosol streams, which may have different attributes and may be emitted in different directions. One stream may be an upwardly directed fogger stream and the other stream may be a forwardly directed, aimable stream. This permits a user to direct, for example, an insecticide at a particular target, while simultaneously more generally fogging an area of interest.

15 Claims, 4 Drawing Sheets

AEROSOL DISPENSING NOZZLE

CROSS-REFERENCE TO RELATED APPLICATIONS

Not applicable

STATEMENT REGARDING FEDERALLY SPONSORED

RESEARCH/DEVELOPMENT

Not applicable

BACKGROUND OF THE INVENTION

The present invention relates to aerosol dispensing devices. More particularly, it relates to nozzle inserts mountable in the outlets of overcap actuators, and, alternatively, nozzle outlet structures formed as a unitary part of an actuator, that provide multiple simultaneous sprays.

Aerosol cans dispense a variety of ingredients. One or more chemicals or other active ingredients or materials to be dispensed are usually mixed in a solvent and, in any event, typically are mixed with a propellant. Typical propellants are carbon dioxide, a selected hydrocarbon gas, or mixtures of hydrocarbon gases, such as a propane/butane mix. For convenience, materials to be dispensed will sometimes be referred to herein merely as "actives", regardless of their chemical nature or intended function.

The active/propellant mixture is stored under pressure in the aerosol can. The mixture is then typically sprayed out of the can by pushing down or sideways on an activator button at the top of the can that controls a release valve mounted in the top end of the can. The sprayed active may exit in an emulsion state, single phase, multiple phase, and/or be partially gaseous. Without limitation, actives can include insect control agents (such as a repellent, insecticide, or growth regulator), fragrances, sanitizers, cleaners, waxes or other surface treatments, and/or deodorizers.

In simple arrangements, pressure on a valve control stem can be provided by finger pressure on a button attached to the stem and having an internal passage way that leads can contents to an outlet on the side of the button. In response to actuation of the valve, the can contents are permitted to pass through to the outlet via the internal passage way, and thus there is created a spray that exits to the ambient environment.

In some cases it is desirable to direct or aim a particular active at a known desired target. For example, a user may see a mosquito or fly in the air or resting on the floor and desire to specifically aim an aerosol spray at it. In other cases, it may be desirable to emit that same active in a fog or other less specifically aimed form, for example to fumigate a room or large space to clear it of possible insects. Herein, a "directed" or "aimable" spray will mean a spray pattern such that the sprayed particles or droplets are moving predominantly in a substantially single direction so as to allow a user to effectively point a spray at an insect or other localized target or space. In contrast, "fog" or "fogging" spray is meant to refer to an aerosol delivery that is widely dispersed and more randomly turbulent and broken up than a stream created to be aimed at a specific target such that sprayed particles or droplets are projected in a turbulent, predominantly random pattern.

Moreover, users will intuitively expect an aerosol can sprayer for aimed delivery at a target to direct a flow that is essentially perpendicular to the axis of the can. In contrast, the optimal angle for fogging will typically be at an upwardly directed angle. Thus, nozzles designed for aimed spraying of insecticides at specific targets are largely non-ideal for fogging and vice versa.

In some situations it is particularly desirable to have both a fogging and a targeting capability. For example, if one wanted to spray a picnic shelter one might prefer to be able to simultaneously fog the shelter and also target specific insects that might be visible at the time of spraying. One could design specific purpose nozzle inserts to be easily removable from a sprayer outlet, and provide the user with the option to replace a nozzle with a different type of nozzle when a different function is desired. However, this would require the user to store at least one replacement nozzle between uses and to undertake assembly steps that could expose the user to the active when removing a first nozzle.

Analogous issues exist with respect to fragrancers and disinfectants. Spray nozzles configurations that are particularly suitable for treating an entire room are not optimal for targeting a particular location (e.g. a toilet bowl). As such, a need exists for improvements in the spraying capability of a wide variety of aerosol dispensers.

BRIEF SUMMARY OF THE INVENTION

The invention provides a nozzle insert for an aerosol dispenser for dispensing pressurized material from a can or other container. Aerosol dispensers include actuators that deliver can contents from a valve mounted in the can, via a through conduit or passageway in the actuator, to an actuator exit, where the material to be dispensed is released to the air. The insert's inlet or upstream end is suitable to be mounted in the actuator exit, so that the dispensed material passes through the conduit and out the outlet or downstream end of the insert.

The insert will preferably have an elongated body with an inlet end suitable to be mounted at the exit of an actuator for the aerosol dispenser, an outlet end, and a conduit there between. The outlet end has two separate outlets in communication with the conduit. The two outlets are so configured as to impart differing flow characteristics to the spray of material dispensed therefrom. "Flow characteristics" is defined to include but not be limited to such characteristics as angle of flow, direction or coherence of the dispensed spray, and the like. When material to be dispensed from the aerosol dispenser is delivered to the conduit, the nozzle insert will simultaneously project a first spray from one of the separate outlets and a second spray that is independent from the first at the time of exit from the other of the separate outlets.

In other preferred forms the two outlets have different cross sectional profiles or other spray modifying features. For example, one can be an elongated slot that extends both radially and axially with respect to the longitudinal axis of the nozzle insert, and the other can be a generally circular outlet hole that extends axially with respect to the longitudinal axis of the nozzle insert. Alternatively, the outlets can both be such elongated slots, where the slots are at least partially directed in radial opposition to each other.

In still other preferred forms the insert can be made so as to be suitable to be inserted and retained in a friction fit manner within the exit of the actuator. For example, the insert can be conical, with its diameter increasing from the inlet to the outlet end. Alternatively, the insert can be generally cylindrical, with a first upstream section of a first diameter, a collar section downstream of the first upstream section and having a diameter larger than the first diameter, and a cap section downstream of the collar having a diameter larger than the diameter of the collar. The two outlets can then be located in the cap section. When this shape of insert is used, the actuator exit can have corresponding stepping in diameters. Friction fitting inserts into actuator exits is well known in the aerosol art, and any conventional shapes and materials to accomplish friction fitting are within the breadth and scope of the invention.

In another aspect the invention provides an actuator for use with a can containing pressurized material to be dispensed, typically as an aerosol. The actuator includes a receiver to engage the valve stem of an aerosol can, the receiver having a recess for receiving the valve stem and a through conduit for passing material to be dispensed from the can to an actuator exit. There is also a nozzle structure positioned at the actuator exit (which nozzle structure may, if desired, be integrally formed with the actuator or may be a separately formed insert positioned within the actuator exit). The nozzle structure has two separate exits in communication with the actuator's through conduit. If the material to be dispensed is delivered to the through conduit, the nozzle structure will simultaneously project a first spray from one of the separate exits and a second spray from the other of the separate exits.

The actuator can be a part of an overcap. Such an overcap can be mounted in any conventional manner on the can. The actuator is linked, preferably via a living hinge, to an outer skirt or other part of the cap. The actuator includes a receiver for engaging the can's valve stem. Preferably, the receiver is unitarily formed with the remaining parts of the actuator, with a through passage leading to an actuator exit equipped with a nozzle having two outlets having the outlet features described above.

Alternatively, the receiver can be a part of a separate structure mounted on the valve stem and simply be so engaged by the remainder of the actuator as to allow movement of the actuator to move the separate structure. The separate structure mounted on the valve stem can be, for example, an aerosol push button, as generally described above, positioned on the valve stem, with the exit of the push button configured with two outlets having the outlet features described above.

In yet another form the invention provides a method of delivering a sprayable active from an aerosol container to the ambient environment. One provides an aerosol container containing sprayable material to be dispensed, the container having an exit valve. One then actuates the exit valve to deliver an exit stream of the material to be dispensed from the container, and then divides the stream into two independent streams at an outlet nozzle. At this point, the two streams are emitted from the nozzle into the ambient environment in a form in which they are independent at the time of exiting the nozzle.

In a preferred form of the method of the invention one such stream is emitted into the ambient environment in the form of a fog, and one such stream is emitted into the ambient environment as a directed spray. If desired the two independent streams both can be emitted into the ambient environment as fogs, in at least partial radial opposition to one another. Alternatively, one such independent stream can be emitted in an essentially axial direction relative to the longitudinal axis of the nozzle as a more directed and aimable stream, and the other independent stream can be emitted as a fog at least partially radially directed with respect to said axis.

The foregoing and other advantages of the invention will appear from the following description. In the description reference is made to the accompanying drawings which form a part thereof, and in which there is shown by way of illustration preferred embodiments of the invention. Such embodiments do not represent the full scope of the invention, and reference should therefore be made to the claims herein for interpreting the scope of the invention.

DETAILED DESCRIPTION OF THE PREFERRED EMBODIMENT

Representative conventional aerosol containers and actuators, and valving used therewith, are disclosed in U.S. Pat. Nos. 5,068,099 and 6,006,957. The disclosures of these patents are hereby incorporated by reference as if fully set forth herein. It should be appreciated from the descriptions below that these structures provide examples of environments in which the nozzle inserts, and actuator nozzle outlet structures, of the present invention can be applied.

Figure 1:
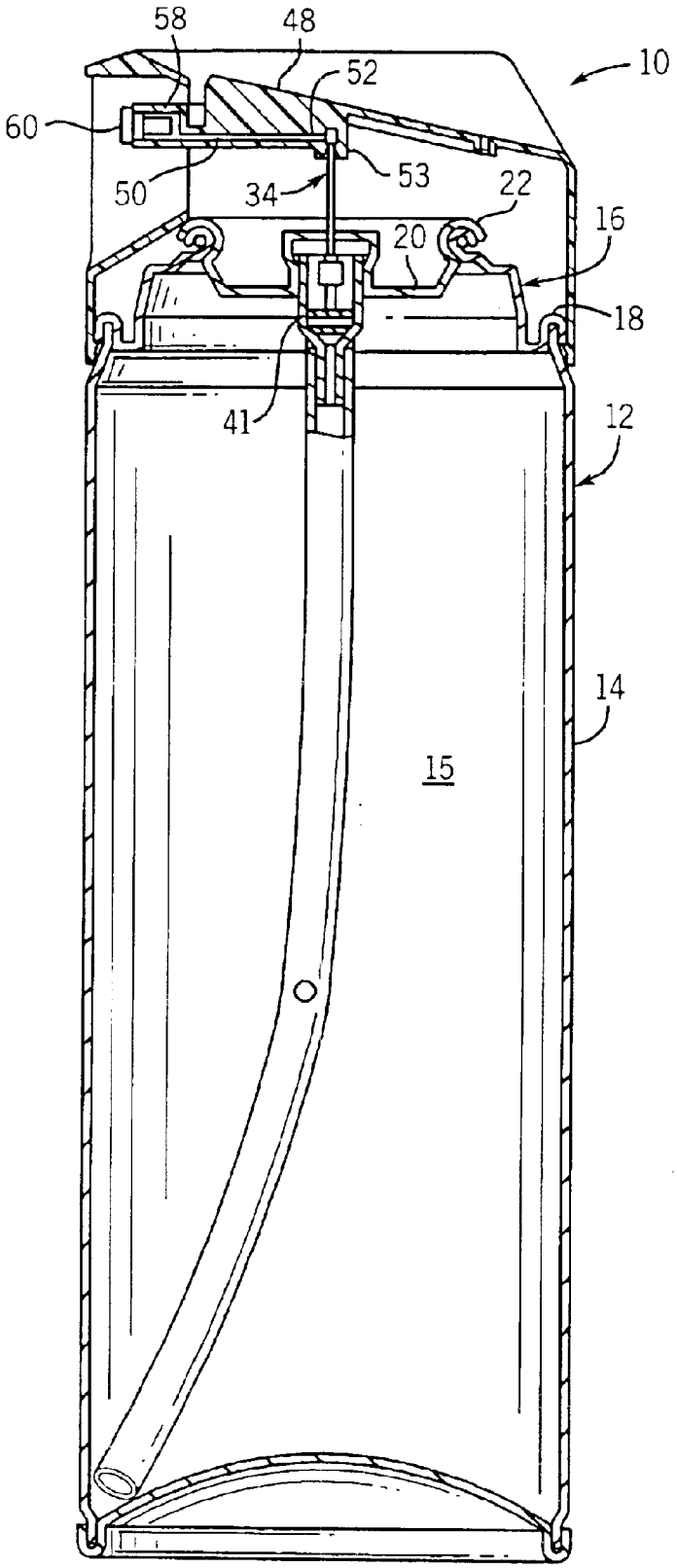
FIG. 1 is a side elevation view, partially in section, of an aerosol can having a nozzle insert and actuator constructed in accordance with the present invention.

A particular embodiment of such an aerosol container and actuator assembly, as constructed in accordance with the present invention, appears in FIG. 1. There an aerosol dispenser 10 includes a container 12, such as a conventional aerosol metal (e.g. aluminum; steel) can, that defines an internal chamber 15 capable of housing under pressure material to be dispensed. Container 12 includes a cylindrical wall 14 that is closed at its upper margin by a dome 16. The upper margin of the can wall 14 is joined to the dome via a can chime 18. An upwardly open valve cup 20 is located at the center of the dome 16 and is crimped or otherwise joined to the dome to form a valve cup rim 22 in a conventional manner.

The aerosol dispenser 10 includes a conventional aerosol valve 41 (see e.g. U.S. Pat. No. 5,068,099 for another such valve) crimped to the valve cup 20 at the valve cup rim 22 in a conventional manner. The aerosol valve 41 has a valve stem 34 that is hollow and extends axially up from the valve cup 20.

A variety of other conventional aerosol valves are well known to the art. These valves are activated by moving their valve stems downwardly and/or sidewardly. Upon such activation, pressurized material to be dispensed that is contained within the container is delivered from the valve stem.

In the present invention an actuator 48 is mounted in cooperative relation to the valve stem 34. The actuator 48 may be mounted exclusively on the valve stem 34, in the manner of a common aerosol button, or it may be part of a overcap or other structure mounted on the chime 18 or valve cup rim 22. Such alternative modes of mounting actuators to aerosol cans are well known in the art, and the instant invention is not limited to any particular mounting strategy.

The actuator 48 has an actuator through passage 50 that extends from an actuator inlet end 52 to an actuator outlet end 58. The actuator inlet end 52 has a receiver 53 capable of receiving the valve stem 34 in liquid-tight relation. Particularly in accordance with the present invention, a nozzle insert 60 is mounted in the actuator outlet end 58. The nozzle insert 60 is in the form of an elongated, generally tubular body having an inlet end 61, an outlet end 63, and a conduit 65 communicating there between (see especially FIG. 3). The nozzle insert 60 can be made by conventional injection molding techniques and is preferably made of a resilient plastic such as polypropylene or polyethylene. When the aerosol valve 41 is activated, material to be dispensed is released to travel through the actuator via through actuator through passage 50 and be discharged to the atmosphere through the nozzle insert 60.

Figure 2:
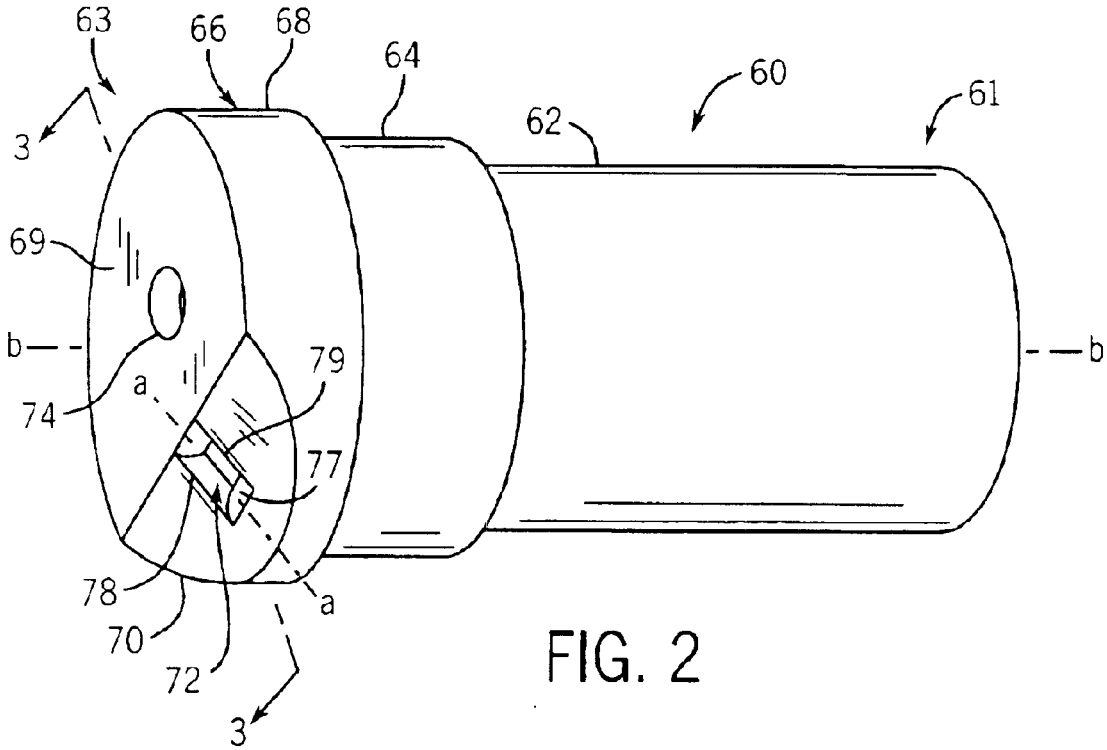
FIG. 2 is an enlarged perspective view of a first nozzle insert.
Figure 3:
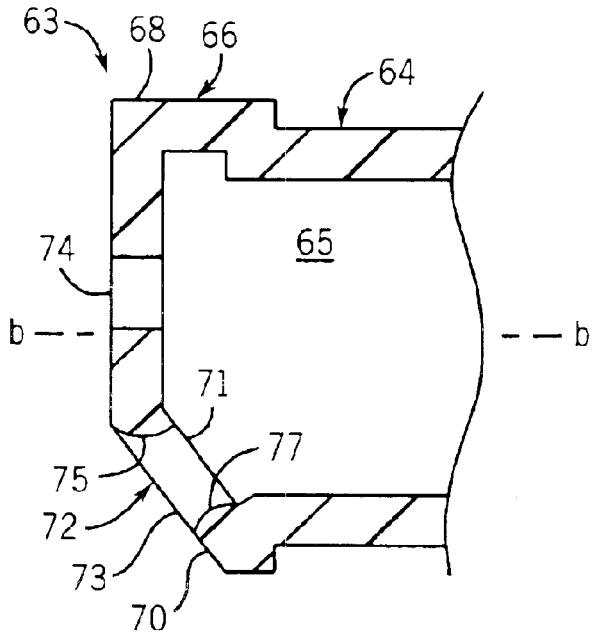
FIG. 3 is a further enlarged sectional view of a portion of the FIG. 2 insert, taken along line 3—3 of FIG. 2.
Figure 4:
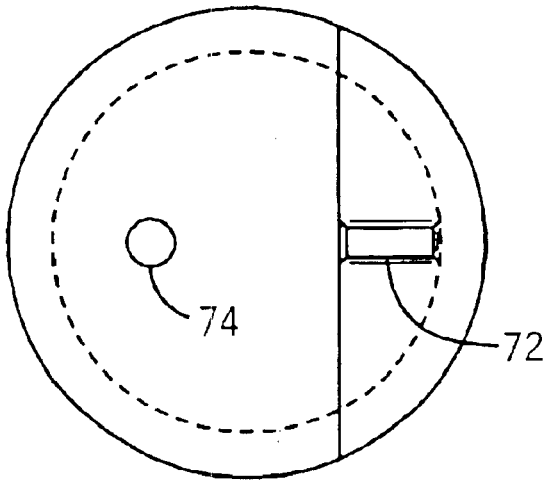
FIG. 4 is an end elevational view of the FIG. 2 insert.

Referring next to FIGS. 2–4, the nozzle insert 60 can be structured so as to split the single flow of material delivered through the actuator through actuator through passage 50 into two independent output streams to be separately emitted into the ambient environment (e.g. as a directed spray in one stream, and as a fog in the other stream). In the FIG. 2 preferred embodiment, the nozzle insert 60 includes an elongated cylindrical base section 62 disposed at the inlet end 61 of insert 60. The diameter of base section 62 is stepped outwardly to form a collar section 64 that is disposed downstream the base section. Collar section 64 is preferably, but not necessarily, integral with the base section 62. A cap section 66 having a greater diameter than the collar section is disposed at the distal end 63 of the insert 60. Cap section 66 is preferably, but not necessarily, integral with the base and collar sections. These sections are each preferably annular and concentric about a longitudinal axis b—b of insert 60.

Insert 60 is preferably installed into actuator through passage 50 during manufacturing by inserting base section 62 into actuator through passage 50. The outer diameter of insert 60 is sized to be retained by friction within actuator through passage 50. Also, base section 62 has an outer diameter that is sufficiently less than the inner diameter of actuator through passage 50 so as to enable the inlet end 61 of insert to be easily initially guided into the actuator through passage 50.

The collar section 64 has an outer diameter that is almost equal to the inner diameter of actuator through passage 50 such that as the insert 60 is further slid inwardly the collar section 64 interferes with the actuator through passage 50. Alternatively, the inner diameter of actuator through passage 50 could be tapered or stepped to further enhance the engagement with collar section 64 as the insert 60 is further inserted. The cap section 66 has an outer diameter sufficiently greater than the inner diameter of actuator through passage 50 such that the cap section 66 abuts the outer edge of actuator through passage 50 to provide a stop when the insert 60 is fully inserted in the actuator through passage 50.

The configuration of insert 60, and in particular the fit between collar section 64 and actuator through passage 50, render the dispenser suitable for mass production at a relatively low cost. Furthermore, insert 60 is compatible with conventional actuator over caps, thereby further reducing cost. It should be appreciated that while the dispenser 10 is configured such that the insert 60 extends radially with respect to the direction of axial extension of the container 12, the present insert 60 is also compatible with dispensers whose outlet extends in the same direction as the axis of container 12.

Referring now to FIG. 2 in particular, the cap section 66 includes a stepped outer radial wall 68 having an axially outer face 69. Face 69 presents a beveled surface 70 at the intersection between the axially outer edge of wall 68 and radially outer edge of face 69 such that surface 70 faces both radially and axially outwardly from insert 60. A cylindrical aperture 74 extends axially through surface 69 and is in fluid communication with actuator through passage 50 to form a first outlet for aerosol content when the valve 34 is actuated. Outlet 74 does not need to be centrally disposed on surface 69, and therefore can be in a position where it is not aligned with axis b—b.

Referring next to FIG. 4, outlet 74 is sized and shaped to emit aerosol content as an aimable spray, preferably to focus delivery of sprayed material on an insect, toilet bowl, corner of a room, or similarly discrete target at a convenient distance. Outlet 74 is so shaped as to emit a roughly conical spray pattern suitable for aiming at an insect or other target. It should be appreciated, however, that any aperture having a size and shape suitable to emit an aimable, directed spray is contemplated by the present invention.

Elongated slot 72 extends through surface 70 to form a second outlet for material to be dispensed delivered via actuator through passage 50 and insert 60. Outlet slot 72 may be essentially trapezoidal in cross section and is designed to emit a fog during operation. Slot 72 is orientated such that the axis of extension a—a of slot 72 in FIG. 2 is co-planar with the axis of extension b—b of insert 60.

To particularly facilitate fogging we prefer that at least some of the side walls of the slot 72 be rounded outwardly at their outer end. This may be done on all four such walls, or preferably at least on walls 77, 78 and 79 (see especially FIG. 2).

Figure 5:
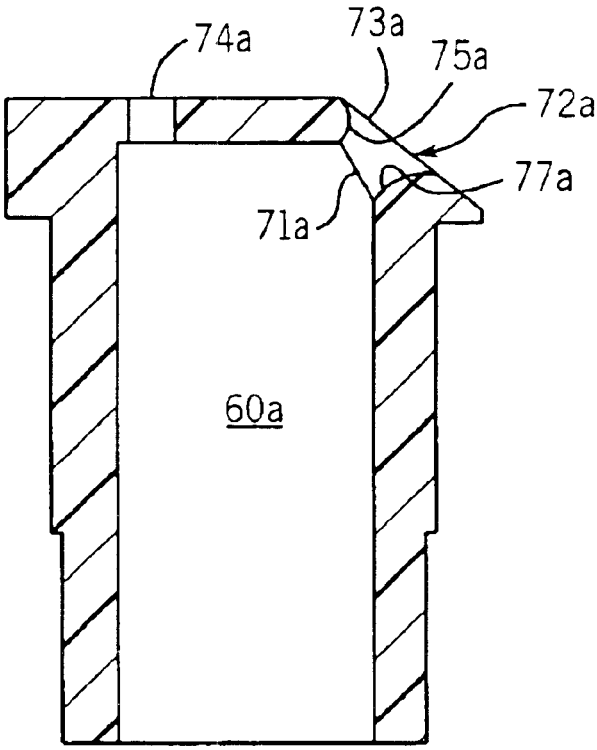
FIG. 5 is a sectional view (analogous to that of FIG. 3, but of the entire section) through a second embodiment.

Referring next to the FIG. 5 variant 60*a*, outlet 72*a* is also an elongated slot. The cross-sectional area of outlet 72*a*, at it's upstream end 71*a*, is narrower than its cross-sectional area at its downstream end 73*a* to provide a widening profile with respect to the direction of aerosol flow. This configuration creates turbulence in the aerosol spray passing through outlet 72*a* which, in turn, enhances a dispersed spray pattern that is suitable for creating a fogging spray rather than a directed spray. The rounding creates a sideways turbulence into the aerosol flow to provide an even more dispersed, yet fan-shaped fogging pattern.

The radially inner surface 75*a* of outlet 72*a* extends essentially parallel to axis b—b of insert 60 (but for some slight rounding), while the radially outer surface 77*a* of outlet 72*a* is tilted away from axis b—b to further accomplish the widening effect described above. It should be appreciated, however, that any aperture having a size and shape suitable to emit a fog is contemplated by the present invention.

Accordingly, during operation, a user may aim the outlet 74*a* to direct a spray of material to be dispensed towards a predetermined target, while positioning outlet 72*a* towards an area of a room or the like that is to receive the material to be dispensed as a fog. When the actuator 48 is depressed and the valve 34 is thereby opened, the material to be dispensed delivered via actuator through passage 50 is split by the insert and travels through both outlets. Consequently, a first aerosol output is emitted axially outwardly (radially outwardly with respect to container 12 and user) via outlet 74*a* as a directed spray.

A second aerosol output is also emitted as a fog that flows both axially and radially outwardly with respect to the insert 60*a* via outlet 72*a*. Advantageously, both the directed spray and fog are simultaneously emitted away from the user when the device is operated properly.

It should be appreciated that the material to be dispensed need not only be insecticides, although insecticides are a preferred material. Other known types of materials could be used as well when there is a desire to provide multiple distinct streams, particularly streams having different characteristics.

Figure 6:
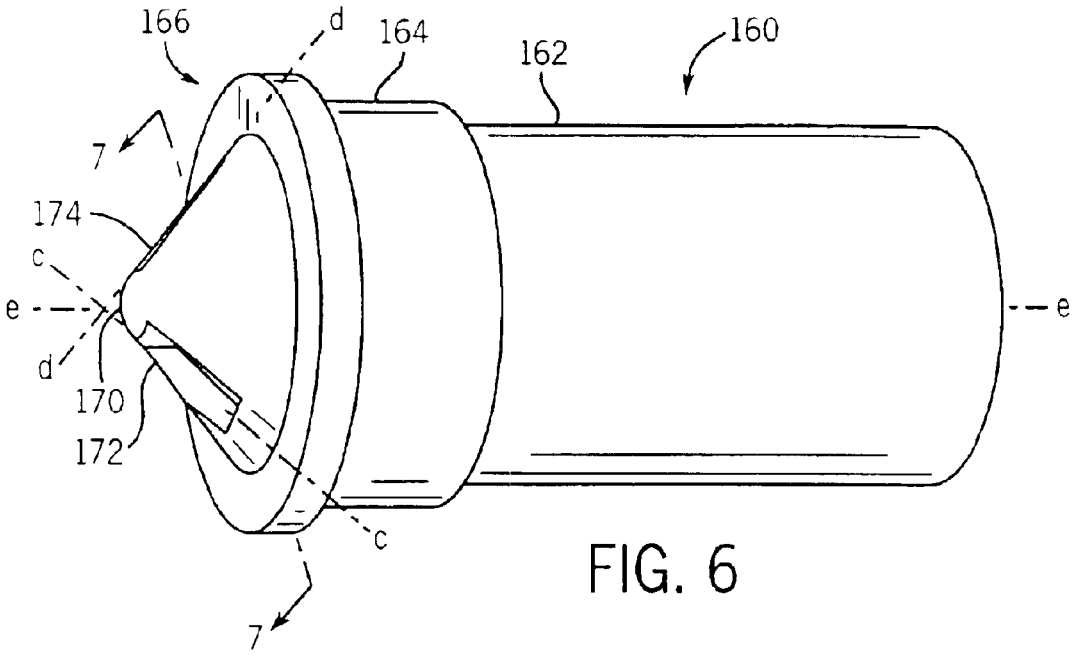
FIG. 6 is a perspective view (similar to the FIG. 2 perspective view) of a third embodiment.
Figure 7:
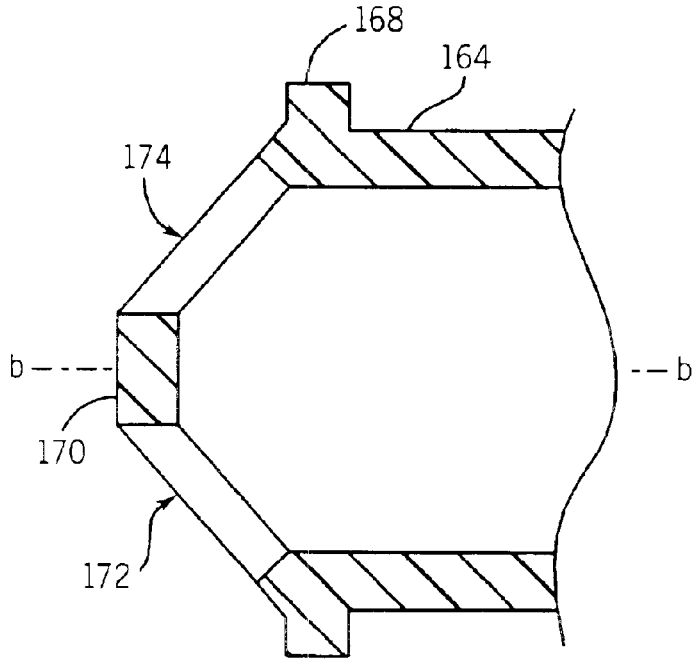
FIG. 7 is a view similar to the FIG. 3 view, but of the third embodiment and taken along line 7—7 of FIG. 6.

FIGS. 6 and 7 illustrate a third embodiment where there is an insert 160. It has a base section 162 and collar section 164 having the same size and shape as insert 60. However, the cap section 166 is somewhat different. Cap section 166 has a stepped outer radial wall 168 that is integrally connected to conical surface 170 having a pair of opposing elongated slots 172 and 174 extending there through to provide a pair of outlets for insert 160. If desired, slots 172 and 174 can be modified from the configurations shown to each have the same size and shape as slot 72 of insert 60, so that each slot 172, 174 emit the material to be dispensed as a fog. This embodiment is of special use for room or other area fogging, the division of the material to be dispensed into two streams, at least initially, providing an aesthetic distinction from single stream foggers, even if they use a unified fan spray pattern.

Axes of extension of slots 172 and 174 (c—c and d—d), respectively preferably are co-planar with each other and with the axis of extension e—e of insert 160, and intersect a given line extending radially outwardly from the axis of extension e—e. Axes c—c and d—d of slots 172 and 174 are radially offset from each other by 180° with respect to surface 170 and intersect to form a 90° angle. The radial components of the independent fog streams are in opposition to each other to also enable the dispenser 10 to fog a larger volume in a lesser amount of time compared to conventional aerosol fogging devices.

The nozzle slot and other exit structures described herein as being parts of inserts formed separately and positioned in actuator through passages could, alternatively, be formed as integral parts of the actuators, to affect spray patterns in the same manner as described for the inserts. However, separately formed inserts are preferred as being much more convenient to manufacture. All parts discussed may be manufactured by standard injection molding processes.

The above description has been that of preferred embodiments of the present invention. It will occur to those that practice the art, however, that still other modifications may be made without departing from the spirit and scope of the invention.

INDUSTRIAL APPLICABILITY

The present invention provides nozzle inserts and actuators useful in converting aerosol spray streams into multiple stream configurations, and methods for using them.

We claim:

1. A single nozzle insert member for an aerosol dispenser containing pressurized material to be dispensed, the insert member comprising:

an elongated body having an inlet end suitable to be mounted in an exit of an actuator for the aerosol dispenser, an outlet end, a conduit there between, and a single cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets.

2. A single nozzle insert member for an aerosol dispenser containing pressurized material to be dispensed, the insert member comprising:

an elongated body having an inlet end suitable to be mounted in an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the two outlets have different cross sectional profiles from each other.

3. A single nozzle insert member for an aerosol dispenser containing pressurized material to be dispensed, the insert member comprising:

an elongated body having an inlet end suitable to be mounted at an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the two outlets have different cross sectional profiles from each other; and wherein a first outlet comprises an elongated slot that widens in a downstream direction.

4. The single nozzle insert member of claim 3, wherein the elongated slot extends both radially and axially with respect to a longitudinal axis of the nozzle insert.

5. The single nozzle insert member of claim 2, wherein a first outlet comprises a circular outlet hole.

6. A single nozzle insert member for an aerosol dispenser containing pressurized material to be dispensed, the insert member comprising:

an elongated body having an inlet end suitable to be mounted at an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the two outlets have different cross sectional profiles from each other;

wherein a first outlet comprises a circular outlet hole; and wherein the circular outlet hole extends axially with respect to a longitudinal axis of the nozzle insert.

7. A single nozzle insert member for an aerosol dispenser containing pressurized material to be dispensed, the insert member comprising:

an elongated body having an inlet end suitable to be mounted at an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the two outlets have different cross sectional profiles from each other; and wherein the outlets are at least partially directed in radial opposition to each other.

8. A single nozzle insert member for an aerosol dispenser containing pressurized material to be dispensed, the insert member comprising:

an elongated body having an inlet end suitable to be mounted in an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the insert is a unitary housing made of a flexible material.

9. A single nozzle insert member for an aerosol dispenser containing pressurized material to be dispensed, the insert member comprising:

an elongated body having an inlet end suitable to be mounted at an exit of an actuator for the aerosol dispenser, an outlet end, a conduit there between, and a cap at the outlet end;

the cap having two separate outlets in communication with the conduit, the two outlets so configured as to impart differing flow characteristics to the stream of material dispersed therefrom;

whereby when material to be dispensed from the aerosol dispenser is delivered to the conduit, the nozzle insert will simultaneously project a first spray having a first flow characteristic from one of the separate outlets and a second spray having a second flow characteristic and that is independent from the first spray at the time of exit from the other of the separate outlets;

wherein the insert is generally cylindrical, with a first upstream section of a first diameter, a collar section downstream of the first upstream section and having a diameter larger than the first diameter, and a cap section downstream of the collar section having a diameter larger than the diameter of the collar section.

10. An actuator for an aerosol dispenser, comprising:

a receiver and a through conduit in fluid communication with an actuator outlet, the receiver being connectible to a valve stem that extends from the dispenser, the receiver having a recess for receiving the stem and the through conduit being sized to pass material to be dispensed and contained in the aerosol dispenser to that actuator outlet; and a nozzle integrally formed with the actuator and positioned at that actuator outlet, the nozzle having two separate outlets in communication with the through conduit, the two outlets being so configured as to impart differing flow characteristics to the stream of material dispensed therefrom;

whereby, when material to be dispensed from the aerosol dispenser is delivered to that through conduit, the nozzle simultaneously projects a first spray having a first flow characteristic from one of the separate outlets and a second spray having a second flow characteristic from the other of the separate outlets;

wherein the actuator is in the form of a push button.

11. The actuator of claim 10, wherein the actuator is part of an overcap.

12. A method of delivering a sprayable material to be dispensed from an aerosol container to an ambient environment, the method comprising the steps of:

(a) providing an aerosol container containing a sprayable material to be dispensed, the container having an exit valve;

(b) actuating the exit valve to deliver a stream of the material to be dispensed from the container, and then dividing the stream into two independent streams at an outlet nozzle; and (c) emitting the two independent streams from a single outlet cap of the nozzle into the ambient environment, the two streams differing from each other in flow characteristics;

wherein at least one such stream is emitted into the ambient environment in an upward direction when a longitudinal axis of the can is held vertical.

13. The method of claim 12, wherein at least one such stream is emitted into the ambient environment directed essentially horizontally when the aforesaid axis of the can is held vertical.

14. A method of delivering a sprayable material to be dispensed from an aerosol container to an ambient environment, the method comprising the steps of:

(a) providing an aerosol container containing a sprayable material to be dispensed, the container having an exit valve;

(b) actuating the exit valve to deliver a stream of the material to be dispensed from the container, and then dividing the stream into two independent streams at an outlet nozzle; and (c) emitting the two independent streams from a single outlet cap of the nozzle into the ambient environment, the two streams differing from each other in flow characteristics;

wherein the two independent streams are initially emitted into the ambient environment in at least partial radial opposition to one another.

15. A method of delivering a sprayable material to be dispensed from an aerosol container to an ambient environment, the method comprising the steps of:

(a) providing an aerosol container containing a sprayable material to be dispensed, the container having an exit valve;

(b) actuating the exit valve to deliver a stream of the material to be dispensed from the container, and then dividing the stream into two independent streams at an outlet nozzle; and (c) emitting the two independent streams from a single outlet cap of the nozzle into the-ambient environment, the two streams differing from each other in flow characteristics;

wherein one such independent stream is emitted in an essentially axial direction relative to a longitudinal axis of the nozzle, and the other independent stream is emitted at least partially radially with respect to said axis.

* * * * *